US009504284B2

(12) United States Patent
McKinlay

(10) Patent No.: US 9,504,284 B2
(45) Date of Patent: Nov. 29, 2016

(54) VERSATILE FEMALE SHAPEWEAR GARMENT

(71) Applicant: Carly McKinlay, Mississauga (CA)

(72) Inventor: Carly McKinlay, Mississauga (CA)

( * ) Notice: Subject to any disclaimer, the term of this patent is extended or adjusted under 35 U.S.C. 154(b) by 238 days.

(21) Appl. No.: 14/121,552

(22) Filed: Sep. 17, 2014

(65) Prior Publication Data

US 2016/0073718 A1 Mar. 17, 2016

(51) Int. Cl.

| | |
|---|---|
| ***A41D 27/08*** | (2006.01) |
| ***A41D 31/00*** | (2006.01) |
| ***A41D 1/14*** | (2006.01) |
| ***A41D 1/22*** | (2006.01) |
| ***A41D 15/00*** | (2006.01) |

(52) U.S. Cl.

CPC ..... *A41D 31/00* (2013.01); *A41D 1/14* (2013.01); *A41D 1/22* (2013.01); *A41D 15/002* (2013.01); *A41D 27/08* (2013.01); *A41D 2400/38* (2013.01)

(58) Field of Classification Search

CPC ..... A41C 1/00; A41D 1/22; A41D 1/14; A41D 27/02; A41D 27/04; A41D 27/06; A41D 15/02

USPC ..... 450/94–97, 114–118, 122–128, 450/131–133, 153, 30–33; 2/220, 221, 212, 2/213, 214, 67, 69, 41, 272.211, 71, 72, 2/74, 75

See application file for complete search history.

(56) References Cited

U.S. PATENT DOCUMENTS

| | | | | |
|---|---|---|---|---|
| 1,931,822 | A * | 10/1933 | Hoffman | A41C 1/00 450/105 |
| 2,253,339 | A | 4/1941 | Livermore | |
| 3,425,246 | A * | 2/1969 | Knohl | D04B 1/108 66/171 |
| 4,377,007 | A | 3/1983 | Sudjian | |
| 5,613,378 | A * | 3/1997 | Popa | A41D 1/06 2/213 |
| 8,769,718 | B2 | 7/2014 | Riehl | |
| 2007/0094765 | A1* | 5/2007 | Summers | A41B 9/08 2/113 |
| 2008/0244805 | A1* | 10/2008 | Griffin | A41C 1/00 2/74 |
| 2013/0095730 | A1 | 4/2013 | Jensen | |

OTHER PUBLICATIONS http://www.sassybax/products/the-convert-a-skirt.html; Product decription; 2 pages; admitted prior art.

* cited by examiner

*Primary Examiner* — Gloria Hale

(57) ABSTRACT

A versatile women's shapewear garment functions as a skirt, dress or skirt extension, and dress. A tubular main portion has an open top and bottom and a seamless dimension of elongation (at least thirteen inches) between the top and bottom and a diameter sufficient to receive a human wearer's torso. It has sufficient elastic material (at least about 4% spandex) so as to smooth and control the wearer's body. The main portion is narrowed to a bandless compression portion adjacent the top; it may have the same amount of spandex as, or more than, the rest of the main portion. A tubular decorative fabric band is attached by serging to the main portion adjacent its bottom and has a width such that it extends a significant distance past the bottom. The decorative band may be ruffles or a smooth colorful band.

20 Claims, 4 Drawing Sheets

VERSATILE FEMALE SHAPEWEAR GARMENT

BACKGROUND AND SUMMARY OF THE INVENTION

The garment according to the invention fulfills the need for women to extend their dress for various reasons with a multi-purpose staple to enhance their existing wardrobe. The garment according to the invention can function as a skirt, dress or skirt extension, and/or dress.

Fashion conscious modern women can face many issues when getting dressed. A woman may find that her dress or tunic is too short for whatever reason, that it's not warm enough, not dressy enough, not appropriate, shows too much leg, needs color, and/or needs renewed excitement. Or perhaps a woman is busy and wants to take an outfit from day to evening in a fashionable, easy way; the garment according to the invention solves many wardrobe issues with one multi-purpose shapewear "skirt."

To date, women have been getting by with various make-do items in their closet to extend their dresses, tunics or tops or even sometimes, they have not been able to wear items in their closet because they did not have an appropriate item to wear to fix their wardrobe issues, rendering some of their wardrobe unworn and useless. The reason being, traditional skirts, undergarments or petticoats may be cumbersome and likely will not be smooth or maintain control. A typical skirt may have a waistband, pockets or a finish on it that would show through if a dress or skirt was worn over it if the typical skirt was used as a dress extension. In addition, the fabric of the skirt may conflict with the dress or skirt worn over it and bunch up creating additional problems for the wearer.

An undergarment may have lace or other fixtures on it which would create lumps if a dress or skirt was worn over it.

A petticoat was traditionally just an undergarment for fuller dresses or skirts and most portions of it were not designed to be seen and add any value to the overall look of an outfit. It could also be cumbersome under a skirt or dress due to the fuller nature of it.

Therefore the above traditional make-do items that women have been wearing to extend a skirt or dress, may not have provided the wearer with an improved appearance but rather an unprofessional, messy appearance and more wardrobe issues than without it.

The garment according to the invention provides fashion conscious women with a professional, quality, and comfortable option in the form of a new staple in their wardrobe which will enhance their existing wardrobe for the various reasons mentioned above.

The main garment portion of the garment according to the invention comprises "shapewear." The term "shapewear" in the present specification and claims does not include what is commonly considered a traditional feature thereof, namely that it necessarily functions as an undergarment. While the garment according to the invention can serve primarily as an undergarment it is not restricted to such. Rather the term "shapewear" as used in the present specification and claims means: garment material in a form that smooths and controls the wearer's shape to provide the illusion of a more alluring figure by including a percentage of elastic material, such as spandex or natural latex fibers.

One of the unique features of the garment according to the invention is the provision of a decorative fabric band attached to the bottom of the skirt in the form of a colorful solid band, ruffles (including double ruffles or any number of ruffles), meshes, laminates, ITY (interlock twist yarns), leather strips, etc., which are flexible, stylish and sexy. The fabric patterns vary from solids to geometric patterns to a wide variety of other manifestations. This feature turns the garment according to the invention into not just an undergarment, the typical use for classic shapewear, but as either an undergarment or an outer garment in the form of a skirt, a dress or skirt extension, or a mini-dress. It provides a sexy modern twist on the traditional petticoat.

For example, a woman may be dressing to attend an event and realize that her dress is too short and not appropriate for many reasons. It could be a cool day, raining, and the event requires an outfit "appropriate" for the classy occasion. The garment according to the invention provides a solution to that issue, allowing the woman to still wear the dress but correct the above mentioned problems. She can simply slip the garment according to the invention up under her dress and slide it into her desired position on her body to the length that she wants. The garment according to the invention will act as a dress extension by exposing as much of, or as little of, the band, ruffle, or skirt that the woman wants. This will extend her dress in a fashionable and comfortable way so that it feels more appropriate, while at the same time providing a bit of warmth to fend off the dampness from the rainy day, as well as providing smooth control so as not to be noticed when worn under a dress or skirt as a dress extension, providing the wearer with an aesthetically pleasing and professional, complete look.

Alternatively, the woman can wear a garment according to the invention as a skirt to work, wearing it with a blouse and blazer for a professional look. If she wants to go out to dinner after work and dress up her outfit, she can remove the blazer and wear just the blouse or change her blouse to a dress or another kind of top to look dressier than her work attire. If she'd like to go out to a dance club later in the evening, she can simply remove whatever kind of top she is wearing and slide the garment according to the invention up over her bust line and she will have a mini-dress to wear out dancing.

The garment according to the invention is wrinkle resistant so that it can be rolled up making it ideal for travel. The skirt can be dressed up or down so that the wearer can go from the beach to lunch or dinner providing the wearer fashionable comfort and versatility when one doesn't want to pack too much.

The completely seamless shapewear garment according to the invention is smooth and comfortable when worn under a dress, tunic, top or blouse. Due to the snug nature of shapewear, the skirt can be slid into a desired position to give the wearer whatever length she wants, comfortably, and with the knowledge that it will stay in place. The wearer can slide it up to the bust line, wear it on the waist, slide it onto her hips, or fold it on the waist area (on the hips or waist).

The garment according to the invention may have a wide variety of sizes. For example a mini skirt version may be 14 inches (36 centimeters) long (up to the decorative band) for a "Small" and about one half inch (1.27 centimeters) longer' for each size larger (e.g. Medium, Large, and Extra Large). A "Small" regular length skirt version may be 18.5 inches (47 centimeters) to the decorative band and is preferably about one half inch (1.27 centimeters) longer for each size larger. There is also a commensurate increase in the waist opening as size increases.

The decorative fabric band, in the form of a colorful smooth band or a single set of ruffles, may be about 4 inches (26 centimeters) in finished length from the bottom edge of the skirt to the bottom of the decorative band. In a double ruffle version there is an under layer that may be 4.5 inches (11 centimeters) long so that about one half inch (1.27 centimeters) or so extends below the first outer ruffle. The edges of the ruffles are preferably sewn and finished by a serging machine.

The decorative fabric bands, when smooth bands (not ruffles) on all the skirts are preferably doubled in fabric so that they are folded over at the bottom of the band meaning that no sewing or finished edge is required to finish the bottom of the band. This gives a clean, finished look to the decorative fabric band with no hem showing, thereby enhancing the overall functionality of the seamless shapewear garment.

The smooth band or ruffles are preferably attached at the bottom of the skirt by serging the seams together. This sewing technique ensures the stretch required for the garment is accommodated so as to give a secure yet flexible, long-lasting garment as well as comfort for the wearer. The garment according to the invention stretches when the wearer walks, sits, or crosses her legs. There is only one finished seam on the side of the decorative fabric band (to attach to itself for a finished look) which creates the illusion of the entire garment according to the invention being seamless so as to eliminate lumps or bumps showing through when worn under an outer garment.

According to one aspect of the invention there is provided a combination skirt, dress or skirt extension, and dress, garment for a human wearer comprising: A tubular main garment portion having an open top and an open bottom and having a seamless dimension of elongation of at least about thirteen inches (thirty three centimeters) between the open top and bottom and a diameter sufficient to receive at least part of a human wearer's torso, and having sufficient elastic material so as to smooth and control a human wearer's body. The tubular main garment portion is narrowed to a bandless compression portion adjacent the open top thereof. And a tubular decorative fabric band is operatively attached to the main garment portion adjacent the open bottom thereof and has a width in the dimension of elongation of at least about three inches (seven and one half centimeters) past the open bottom of the main garment portion.

The tubular decorative fabric band may comprise a single set of ruffles or multiple sets of ruffles, or a smooth band (e.g. of a solid color or pattern utilizing as the main color thereof a color aside from white or black or shades thereof). The tubular decorative band is preferably operatively attached to the main garment portion by serging.

The compression portion may have approximately the same percentage of elastic material (e.g. spandex or natural latex fibers) as the rest of the main garment portion, and may have a width of about three to five inches (7.5-12.5 centimeters); or the compression portion may have more elastic material than the rest of the main garment portion, such as at least triple the percentage of elastic material as the rest of the main garment portion. For example the entire garment main portion may have about 5% spandex and the rest non-elastic material such as nylon, and the compression portion 30% spandex (and a width up to about five to seven inches [12.5-18 centimeters]) and the rest nylon or other desirable fibers.

While the main garment portion may have a single thickness if opaque enough to prevent a "see-through" look, preferably the main garment portion is doubled over to form two layers. The two layers are integral at the open top thereof, and both layers are connected to the decorative band at the open bottom. Preferably the layers are substantially unconnected at the rest of the main garment portion, although some stitching may be provided at an intermediate location between the top and bottom.

According to another aspect according to the invention there is provided a garment for a human wearer comprising: A shapewear tubular main garment portion having an open top and an open bottom and having a seamless dimension of elongation between the open top and bottom and a diameter sufficient to receive at least some part of a human wearer's torso. The tubular main garment portion is preferably narrowed to a compression portion adjacent the open top thereof. And, a tubular decorative fabric band of material is operatively attached to the main garment portion adjacent the open bottom thereof by serging, and extends past the open bottom of the main garment portion.

The tubular decorative smooth band is preferably doubled over, and is as described with respect to the previous embodiment. The main garment portion is preferably doubled over to form two layers, as also described above, and is produced on a circular knitting machine. The compression portion also may have the construction of the options set forth above.

The garment may desirably be used in a procedure to provide a dress or skirt extension by positioning the garment under the dress or skirt and then adjusting its location on the wearer's body (held in place by its shapewear construction) so that only all or a significant part of the decorative band is visible from the exterior of the dress or skirt.

According to yet another embodiment of the invention there is provided an ensemble for a human female comprising: An interior skirt of shapewear having an open top and an open bottom and a dimension of elongation of at least about thirteen inches (thirty three centimeters) between the open top and bottom and a diameter sufficient to receive at least some part of a human female wearer's torso. A decorative band of material operatively attached (e.g by serging) to the interior skirt adjacent the open bottom thereof and having a width in the dimension of elongation of at least about three inches (seven and one half centimeters) past the open bottom of the interior skirt. And, an exterior skirt or dress of non-shapewear material surrounding the interior skirt. The interior skirt and exterior skirt or dress are constructed and positioned during use so that when worn by a human female the exterior skirt or dress covers at least most of, and preferably substantially all of, the shapewear but does not cover at least a significant portion of the decorative band.

The details of the interior skirt are preferably as set forth above.

It is a primary object of the present invention to provide a versatile garment of shapewear for use by a human female as either an undergarment, outer garment, or undergarment partially providing an outer garment. This and other objects of the invention will become clear from a detailed description of the specification, and from the appended claims.

DETAILED DESCRIPTION OF THE DRAWINGS

Figure 1:
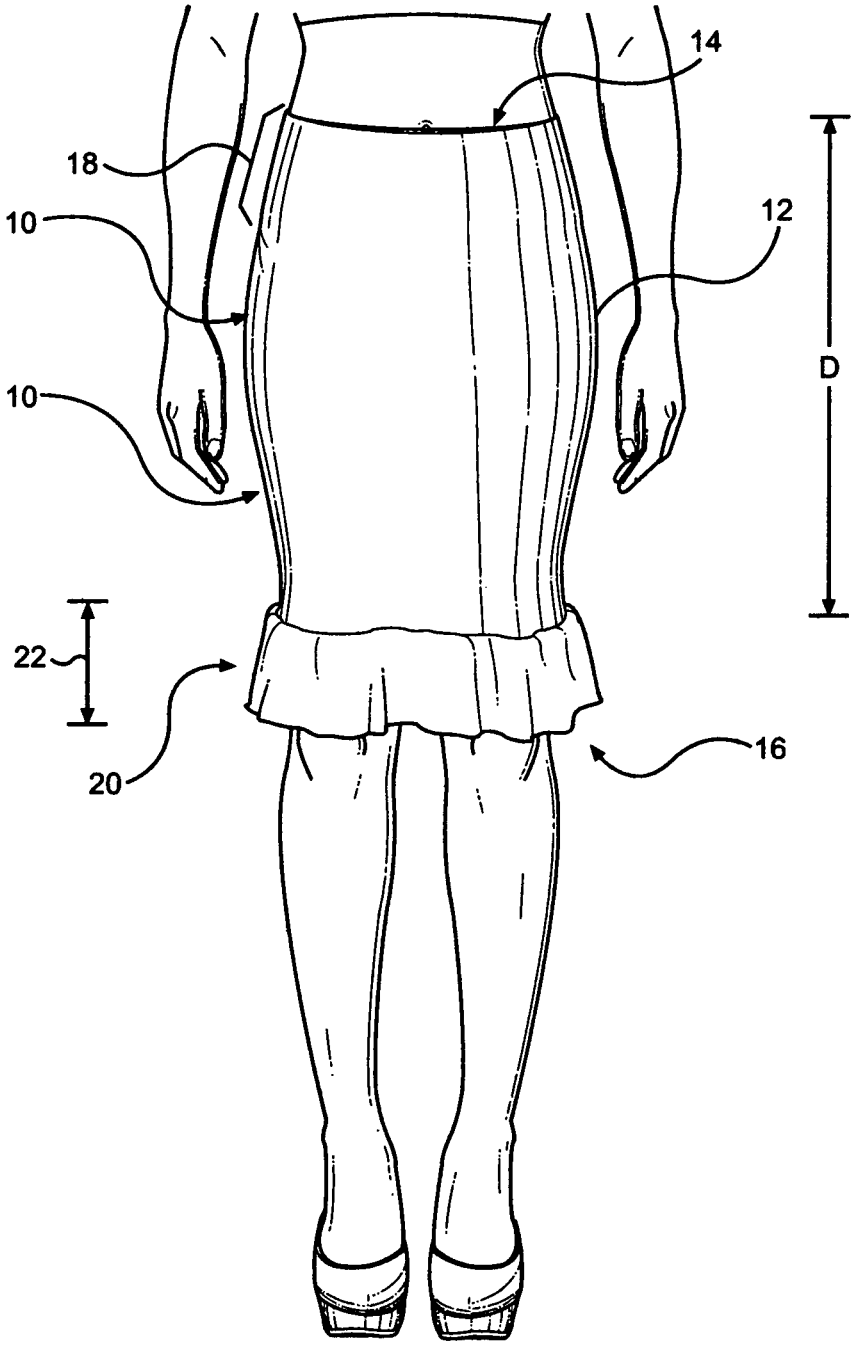
FIG. 1 is a front view of an exemplary garment according to the invention with a decorative band in the form of a single ruffle, and worn by a human female.

FIG. 1 shows, generally by reference numeral 10, an exemplary combination skirt, dress or skirt extension, and dress, garment according to the present invention. The garment 10 comprises a tubular main garment portion 12 having an open top 14 and an open bottom 16, and having a seamless dimension of elongation D. The open top 14, as seen in FIG. 1, typically receives a woman's waist whereas the open bottom 16 terminates at any desired location on the woman such as above her knees, at her knees, or below them.

The dimension D will vary widely depending upon the size of the garment 10, e.g. from XS to XXL. Typically the dimension D is at least about thirteen inches (thirty three centimeters) between the open top 14 and bottom 16 and the garment 10 open top 14 and bottom 16 have a diameter sufficient to receive at least part of a human wearer's torso, as seen in FIG. 1. Without limitation, exemplary lengths for the dimension D are fourteen inches (thirty six cm) for a size S miniskirt and eighteen and one half inches (forty seven centimeters) for a size S so regular length skirt. For each size above S the dimension D would increase by about a half inch (1.27 centimeters). As garment size increases there is also a commensurate increase in waist dimensions.

Another feature of the main garment portion 12 is that it is shapewear as defined above; that is it has sufficient elastic material so as to smooth and control the human wearer's body. Typically, but not limiting, the garment portion 12 has between about 4% and 35% spandex, natural latex fiber, or other conventional elastic material, with the rest some substantially non-elastic fiber such as nylon. One common example is that the garment portion 12 has 5% spandex and 95% nylon; another is 8% spandex and 92% nylon.

According to the invention the tubular main garment portion 12 is narrowed to a bandless compression portion, shown schematically at 18 in FIG. 1, adjacent the open top 14 thereof. The bandless compression portion 18 typically is anywhere from about three and one half and seven inches (7.5 and 18 centimeters) in width (along the dimension D) and may have the same amount of elastic fiber as the rest of the main garment portion 12 (e.g. about 5%), or significantly more, such as at least triple the amount (e.g. about 30%). For example for a "soft compression" main garment portion 12 the bandless compression portion 18 is about four and one half inches (11.5 cm) in width and has 5-8% spandex, while for a "firm compression" main garment portion 12 the bandless compression portion is about six inches (15 cm) in width and has 25-35% spandex.

The garment 10 according to the invention also comprises a tubular decorative fabric band shown generally at 20 in FIG. 1. The decorative band 20 is operatively attached to the main garment portion adjacent the open bottom 16 thereof and has a width 22 in the dimension of elongation D of at least about three inches (seven and one half centimeters) past the open bottom 16 of the main garment portion 12. For example the dimension 22 is typically about four to five inches (10-12.5 cm).

Figure 2:
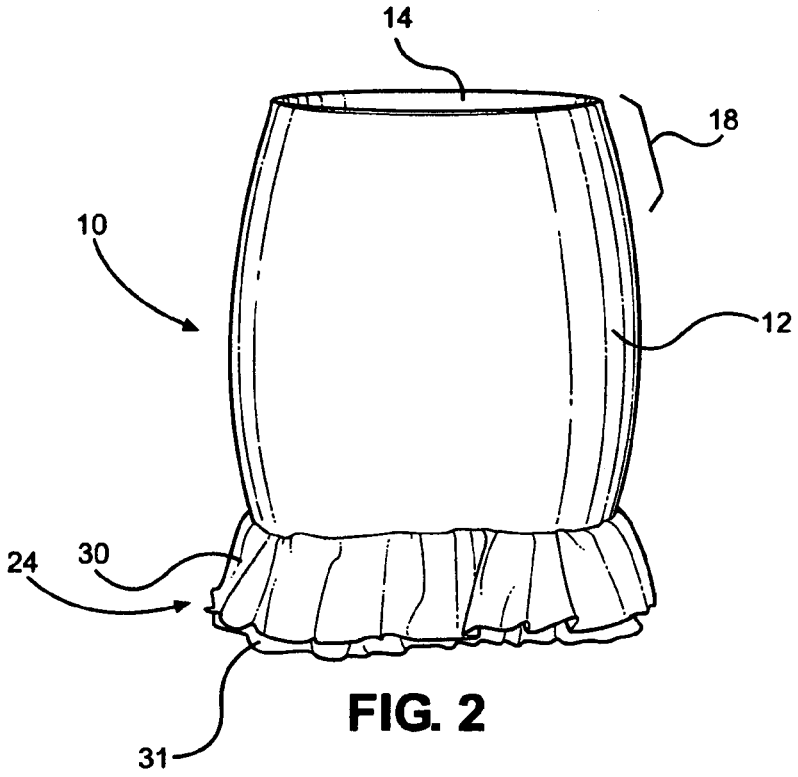
FIG. 2 is a schematic front view of an exemplary garment according to the invention with a decorative band in the form of a double ruffle.
Figure 3:
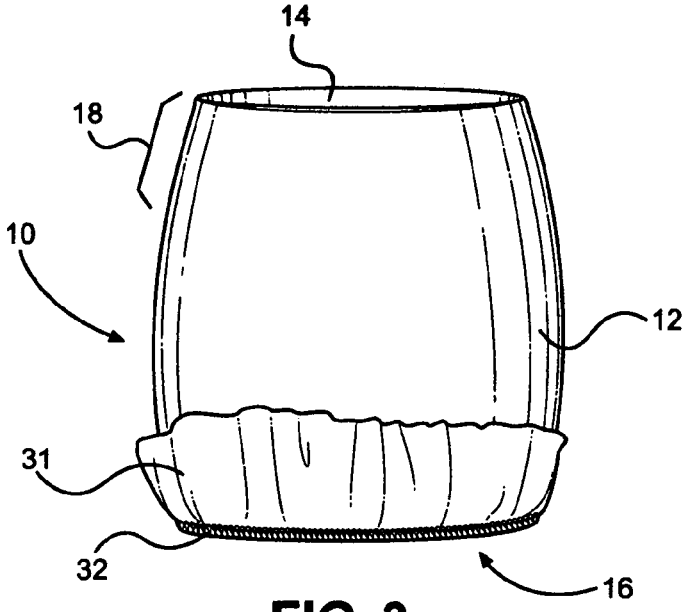
FIG. 3 is a view like that of FIG. 2 showing the decorative band flipped up to expose the stitching connecting the decorative band to the main garment portion.
Figure 6:
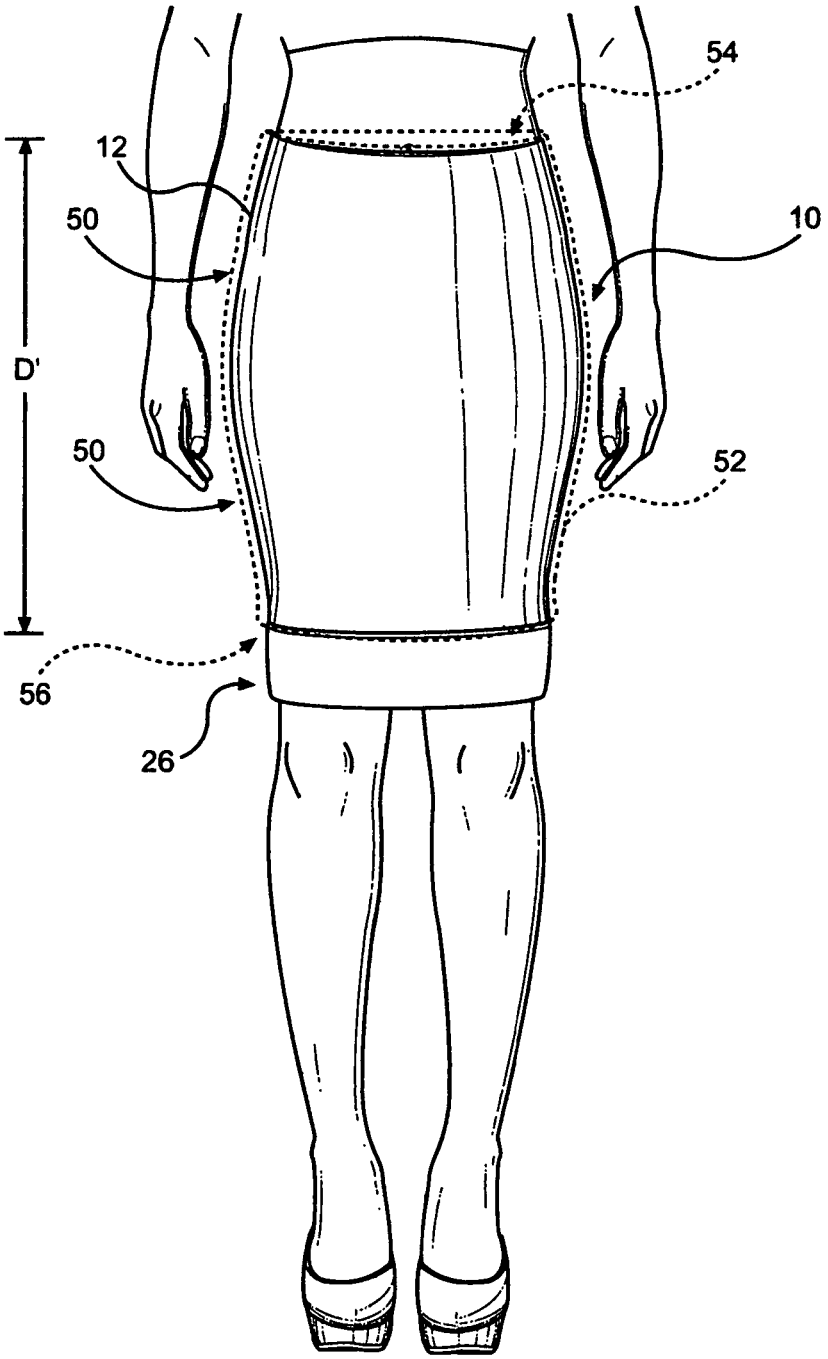
FIG. 6 is a front view of an exemplary ensemble according to the present invention with inner and outer skirts, and showing the outer skirt in dotted line.

In the embodiment illustrated in FIG. 1 the decorative band 20 is in the form of ruffles, but it could take other forms. For example the decorative band 24 in FIGS. 2 and 3 is double ruffles (that is two sets of ruffles), while the decorative band 26 in FIG. 6 is substantially smooth (and desirably has a solid color or pattern utilizing as the main color thereof a color aside from white or black or shades thereof; that is, it is colorful). Other configurations of decorative bands like bands 20, 24, 26 may also be provided, such as non-ruffled meshes, laminates, leather strips, or the like.

In the exemplary embodiment of FIG. 2 double ruffles are provided as the decorative band 24. That is there is an upper layer 30 about four inches (ten cm) in width when doubled over, and there is an under layer 31 that may be 4.5 inches (eleven centimeters) in width so that about one half inch (1.27 centimeters) or so extends below the first outer ruffle 30. The edges of the ruffles are preferably sewn to the main garment portion 12 and finished by a serging machine, as indicated by the serged edges 32 in FIG. 3. The smooth decorative fabric bands 26 are preferably doubled in fabric so that they are folded over at the bottom of the band meaning that no sewing or finished edge is required to finish the bottom of the band. This gives a clean, finished look to the decorative fabric band with no hem showing, thereby enhancing the overall functionality of the seamless shapewear garment 10.

While the main garment portion 12 may be made of a single layer if it is sufficiently opaque, in the preferred embodiment of the invention the main garment portion 12 is doubled over to form two layers. This is best seen with respect to the schematic FIGS. 4 and 5.

Figure 4:
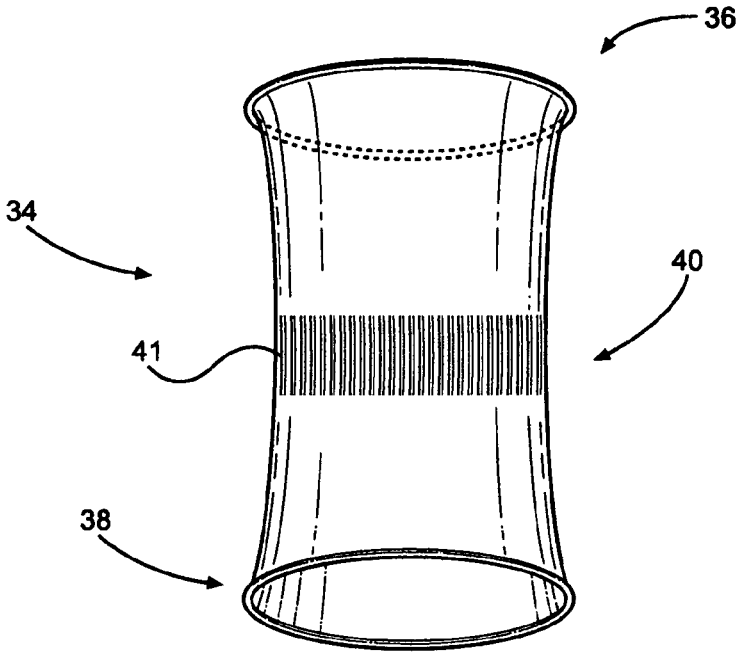
FIG. 4 is a rough isometric view, not to scale, showing a circular knit fabric prior to its formation into the garment of FIGS. 1-3.

FIG. 4 shows a circular knit fabric generally by reference numeral 34 prior to the formation into a garment 10 as in FIGS. 1-3 and 6. The circular knit fabric is wider at the top open end 36 and bottom open end 38 thereof than at the center section 40. As shown schematically in FIG. 4 because of the narrowed nature of the center section 40 even if the same percentage of spandex is provided therein as in the other sections it may take on a ribbed appearance, indicated by reference numeral 41 in FIG. 4.

In making the garment main portion 12 the circular knit fabric 34 will be doubled over so that the open ends 36, 38 are in alignment at the bottom of the garment 10 and will be connected to a decorative band 30 (as shown by the single ruffle embodiment in FIG. 5) by serging 32.

Figure 5:
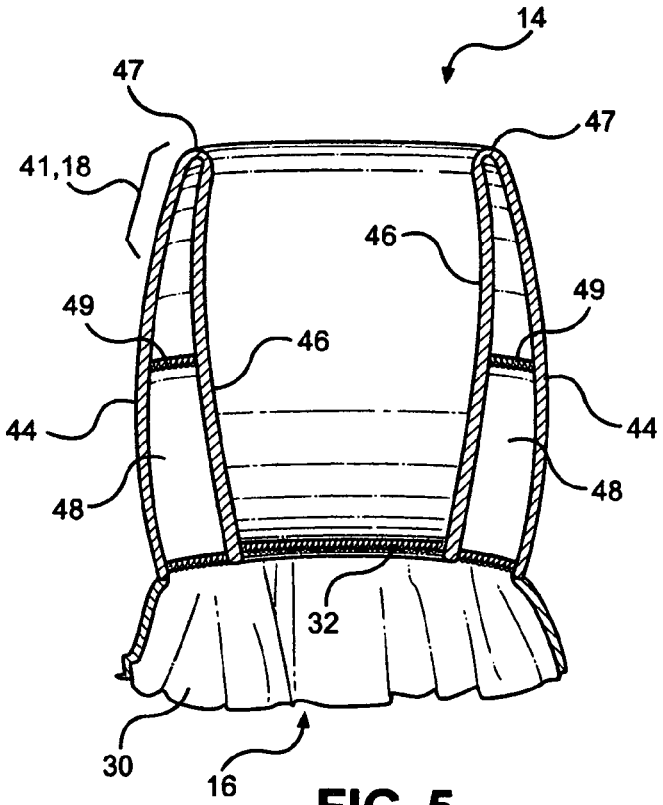
FIG. 5 is a rough schematic cross-sectional view, not to scale, showing the preferred double-layer configuration of the main garment portion made from the circular knit fabric of FIG. 4 and showing a decorative band connected thereto.

FIG. 5, greatly distorted for clarity of illustration, shows the circular knit fabric 34 after it has been doubled over to form two layers 44 and 46. As seen in FIG. 5, the two layers 44, 46, are integral—as seen at 47—at the open top 14 of the garment 10, which is in alignment with the user's waist or hips in use and both layers 44, 46 connected to the decorative band 30. The layers 44, 46 may be substantially unconnected, as schematically illustrated by gap 48 in FIG. 5, at the rest of the main garment portion 12. Alternatively, some stitching—indicated schematically at 49 in FIG. 5—may be provided at one or more intermediate positions (e.g. at the edge of the ribbed area 41, most desirably about four and one-half to six inches from the folded over integral portion 47) to bind the folded over layers 44, 46 together.

FIG. 6 illustrates an ensemble, shown generally by reference numeral 50, according to the invention for a human female. The first part of the ensemble 50 is an interior skirt 10 of shapewear, as described above with respect to FIGS.

1-5; in this case the fabric decorative band 26 is smooth and colorful (e.g. solid red, blue and green stripes, yellow blobs in a white or black background, etc.). The ensemble 50 also comprises a conventional exterior skirt or dress; for purposes of illustration it is shown as a skirt 52, in dotted line, but it also may be a dress, that is extending upwardly from the position illustrated in FIG. 6 to attach to the wearer's shoulders or above the bust.

The skirt/dress 52 is of non-shapewear material and surrounds the interior shapewear skirt 10. When, as illustrated, the skirt/dress 52 is in the form of a skirt it has an open top 54 and an open bottom 56 and dimension D' of elongation between the top and bottom. When the open tops 14, 54 of the interior and exterior skirts 10, 52 are very generally aligned—as schematically illustrated in FIG. 6—when worn by a human female the exterior skirt 52 covers at least most of, and desirably substantially all of the shapewear (portion 12 of garment 10) but does not cover at least a significant portion of the decorative band 26.

Therefore the garment 10 provides a new look for the skirt/dress 52 and extends the length thereof. So that the change in overall look of the skirt/dress 52 is more dramatic, preferably the decorative band 26 (or 20, 24) has a color or pattern or texture (e.g. ruffles) different than the color or pattern or texture of the exterior skirt/dress 52.

Thus, as described above, the garment 10 according to the invention functions as an outerwear skirt, as seen in FIG. 1, whether mini, regular, maxi, etc., or as a skirt or dress extension, as seen in FIG. 6. It can also function as a dress. For example the regular skirt length garment 10 of FIG. 6 can be pulled up by the wearer so that the open top 14 thereof is above her bosom. It is still long enough to cover her crotch area, and thus functions as a mini dress. Since the garment 10 is shapewear, it can be adjusted to almost any position and will still be held securely in place by the elastic nature thereof.

The invention also relates to a procedure of using a shapewear skirt with lower decorative band to function as a dress or skirt extension by adjusting the position of the shapewear skirt under a dress or skirt so that a significant part of the decorative band 30 thereof is seen, and not most or all of the main portion 12.

While the invention has presently been shown and described in what is presently a most desirable embodiment thereof it will be understood that many modifications may be made thereof within the scope of the invention. Also all broad ranges specifically encompass all narrower ranges therewithin. For example an elastic material range of about 4-35% specifically includes 3.75-9%, 28-35.5%, and all other narrow ranges within the broad range. Thus the claims are to be interpreted in the broadest sense possible, limited only by the prior art, to encompass all equivalent structures, products, and procedures.

What is claimed is:

1. A garment for a human wearer comprising:

a tubular main garment portion having an open top and an open bottom and having a seamless dimension of elongation of at least about thirteen inches between the open top and bottom and a diameter which allows the main garment portion to receive at least part of a human wearer's torso, and having elastic material causing the main garment portion to cling to a human wearer's body;

wherein the tubular main garment portion is narrowed to a bandless compression portion adjacent the open top thereof;

a tubular decorative fabric band operatively attached to the main garment portion adjacent the open bottom thereof and having a width in the dimension of elongation of at least about three inches past the open bottom of the main garment portion; and wherein the main garment portion is in the form of two layers, the two layers integral at the open top thereof, and both layers operatively connected to the decorative band and the open bottom.

2. A garment as recited in claim 1 wherein the tubular decorative band comprises a single set of ruffles or multiple sets of ruffles.

3. A garment as recited in claim 1 wherein the tubular decorative band is substantially smooth and has a solid color or pattern utilizing as a main color thereof a color aside from white or black or shades thereof.

4. A garment as recited in claim 1 wherein the tubular decorative band is operatively attached to the main garment portion by serging.

5. A garment as recited in claim 1 wherein the compression portion has approximately the same percentage of elastic material as the rest of the main garment portion.

6. A garment as recited in claim 1 wherein the compression portion has at least triple the percentage of elastic material as the rest of the main garment portion.

7. A garment as recited in claim 1 wherein the main garment portion has between about 4% and 35% spandex or a comparable elastic material, and wherein the compression portion has a width in the dimension of elongation of between about three and one half and seven inches.

8. A garment for a human wearer comprising:

a tubular main shapewear garment portion having an open top and an open bottom and having a seamless dimension of elongation between the open top and bottom and a diameter which allows the main garment portion to receive at least some part of a human wearer's torso;

wherein the tubular main garment portion is narrowed to a compression portion adjacent the open top thereof; and a tubular decorative fabric band operatively attached to the main garment portion adjacent the open bottom thereof by serging, and extending past the open bottom of the main garment portion.

9. A garment as recited in claim 8 wherein the tubular decorative band comprises a single set of ruffles or multiple sets of ruffles.

10. A garment as recited in claim 8 wherein the tubular decorative band is a smooth band, and has two layers.

11. A garment as recited in claim 8 wherein the main garment portion is produced on a circular knitting machine, and wherein the main garment portion is in the form of two layers, the two layers integral at the open top thereof, and both layers operatively connected to the decorative band at the open bottom.

12. An ensemble for a human female comprising:

an interior skirt of shapewear having an open top and an open bottom and a dimension of elongation of at least about thirteen inches between the open top and bottom and a diameter which allows the main garment portion to receive at least some part of a human female wearer's torso;

a decorative band of material operatively attached to the interior skirt adjacent the open bottom thereof and having a width in the dimension of elongation of at least about three inches past the open bottom of the interior skirt; and an exterior skirt or dress of non-shapewear material surrounding the interior skirt and having an open top and an open bottom and dimension of elongation between the top and bottom; and wherein when the interior skirt and exterior skirt or dress are worn by a human female the exterior skirt or dress covers at least most of the shapewear but does not cover a majority of the decorative band.

13. An ensemble as recited in claim 12 wherein the decorative band comprises a single set of ruffles or multiple sets of ruffles.

14. An ensemble as recited in claim 12 wherein the decorative band is substantially smooth and has a color or pattern different than the color or pattern of the exterior skirt or dress.

15. An ensemble as recited in claim 12 wherein the decorative band has two layers, and is operatively attached to the interior skirt by serging.

16. An ensemble as recited in claim 12 wherein the interior skirt is produced on a circular knitting machine and is in the form of two layers, the two layers integral at the open top thereof, and both layers operatively connected to the decorative band at the open bottom.

17. An ensemble as recited in claim 12 wherein the interior skirt narrows to a bandless compression portion adjacent the open top thereof.

18. An ensemble as recited in claim 12 wherein the exterior skirt or dress covers substantially all of the shapewear of the inner skirt when worn by the human female.

19. An ensemble as recited in claim 16 wherein the interior skirt narrows to a bandless compression portion adjacent the open top thereof and wherein the exterior skirt or dress covers substantially all of the shapewear of the inner skirt when worn by the human female.

20. An ensemble as recited in claim 12 wherein the decorative band is operatively attached to the interior skirt by serging.

* * * * *